US009937518B2

(12) United States Patent
Brodbeck et al.

(10) Patent No.: US 9,937,518 B2
(45) Date of Patent: Apr. 10, 2018

(54) APPLICATION NOZZLE

(71) Applicant: Sulzer Mixpac AG, Haag (CH)

(72) Inventors: Thomas Brodbeck, Bonstetten (CH); Andreas Hufschmid, Aarau (CH); Manuel Buck, Gebenstorf (CH)

(73) Assignee: SULZER MIXPAC AG, Haag (CH)

( * ) Notice: Subject to any disclaimer, the term of this patent is extended or adjusted under 35 U.S.C. 154(b) by 0 days.

(21) Appl. No.: 14/893,772

(22) PCT Filed: May 26, 2014

(86) PCT No.: PCT/EP2014/060864
§ 371 (c)(1),
(2) Date: Nov. 24, 2015

(87) PCT Pub. No.: WO2014/191369
PCT Pub. Date: Dec. 4, 2014

(65) Prior Publication Data

US 2016/0114350 A1 Apr. 28, 2016

(30) Foreign Application Priority Data

May 29, 2013 (EP) ..... 13169808

(51) Int. Cl.
*B05C 17/00* (2006.01)
*B05C 17/005* (2006.01)
(Continued)

(52) U.S. Cl.
CPC ..... *B05C 17/00516* (2013.01); *B05B 1/02* (2013.01); *B05C 17/01* (2013.01); *B05C 17/00553* (2013.01); *B05C 17/00566* (2013.01)

(58) Field of Classification Search
CPC .. B05C 17/00516; E04F 21/02; E04F 21/023; E04F 21/16; E04F 21/1652
See application file for complete search history.

(56) References Cited

U.S. PATENT DOCUMENTS 4,946,081 A * 8/1990 Jacobson ..... B05C 17/00516 222/568
4,981,629 A * 1/1991 Cook ..... B05C 17/00516 264/261
(Continued)

FOREIGN PATENT DOCUMENTS

DE 202013003380 U1 * 5/2013 ..... B05C 17/00516
EP 1632293 A1 3/2006
(Continued)

*Primary Examiner* — Jennifer C Chiang
*Assistant Examiner* — Bradley Oliver
(74) *Attorney, Agent, or Firm* — Global IP Counselors, LLP

(57) ABSTRACT

An application nozzle for an application system for gel-like or pasty compositions. The application nozzle includes an inlet region and an outlet region for the composition, and a plane, extending in a longitudinal direction of the application nozzle. The outlet region includes a contact region for the application nozzle on a substrate standing perpendicular to the plane and an outlet opening for the composition. The contact region and the outlet opening are delineated from one another structurally as two separate sections that are kinked with respect to one another, and the contact region is at least partly slanted.

20 Claims, 2 Drawing Sheets

(51) Int. Cl.
*B05C 17/01* (2006.01)
*B05B 1/02* (2006.01)

(56) References Cited

U.S. PATENT DOCUMENTS

| | | | | | |
|---|---|---|---|---|---|
| 5,033,951 | A * | 7/1991 | Cook | B05C 17/00516 | 15/235.3 |
| 5,046,877 | A * | 9/1991 | Longo | B05C 17/00516 | 222/566 |
| 5,249,876 | A | 10/1993 | Hattman | | |
| 5,588,560 | A * | 12/1996 | Benedict | B65D 35/38 | 222/106 |
| 6,926,177 | B1 * | 8/2005 | Scott | B05C 17/00516 | 222/326 |
| 2006/0283978 | A1 * | 12/2006 | Yao | B05C 17/00516 | 239/290 |
| 2007/0210187 | A1 * | 9/2007 | Maier | B05C 17/00516 | 239/458 |
| 2008/0240842 | A1 * | 10/2008 | Blamer | B05C 5/0216 | 401/265 |
| 2009/0152307 | A1 * | 6/2009 | Binder | B65D 25/42 | 222/566 |
| 2009/0194567 | A1 * | 8/2009 | Helmenstein | B05C 17/00516 | 222/521 |
| 2011/0027753 | A1 * | 2/2011 | Maurat | A61C 5/062 | 433/141 |
| 2016/0271629 | A1 * | 9/2016 | Pringle, IV | B05C 17/00516 | |

FOREIGN PATENT DOCUMENTS

| | | | | |
|---|---|---|---|---|
| JP | 1015456 | A | 1/1998 | |
| WO | WO 9741968 | A1 * | 11/1997 | B05C 17/00516 |
| WO | 0174498 | A2 | 10/2001 | |
| WO | 03101630 | A1 | 12/2003 | |

* cited by examiner

APPLICATION NOZZLE

CROSS-REFERENCE APPLICATION

This application is a U.S. National Stage Application of International Application No. PCT/EP2014/060864, filed May 26, 2014, which claims priority to European Application No. 13169808.6, filed May 29, 2013, the contents of each of which is hereby incorporation herein by reference.

BACKGROUND

Field of Invention

The present invention relates to an application nozzle for an application system for gel-like and/or pasty compositions as well as furthermore to an application system, to an application device and to a method of applying a composition.

Background Information

Application nozzles for an application system for applying gel-like and/or pasty compositions such as adhesives or sealants are already known from the prior art.

The processing of gel-like and/or pasty compositions such as adhesives or sealants for establishing adhesive bonds and/or seals has long been known in the most various fields of the art and in daily practice. Different types of packaging configurations and application devices adapted hereto have been developed for the different areas of use which differ substantially in part with respect to their practical demands.

In the industrial area of use, coordinate-controlled systems are dominant in which primarily pumps or pneumatic conveying devices are used for driving the system components out of the respective packaging units. Such systems are only suitable with restrictions for the production of small runs and are generally not suitable for the small trade area.

Previously, manually operated application devices were dominant in the small trade area, for instance in the establishing of adhesive bonds or seals or in replacement glazing for vehicles by customers and for some years there have been mains-powered and battery-powered devices. They have made the energy-sapping driving-out procedure substantially easier for the tradesman and have made it possible at all to use larger packagings with corresponding driving-out forces. However, the area of use is limited. It must further be noted that these devices are sometimes bulky and have a not insignificant weight of up to approximately 5 kg.

The handling of a bulky and comparatively heavy application device is therefore quite tiring and can therefore also have an influence on the even application of the adhesive or of the sealant over time.

To apply the adhesive or sealant uniformly it is necessary always to keep an eye on the application, where possible, and furthermore also not to change the angle of the application device to the substrate on which the adhesive or sealant is being applied, where possible, i.e. not to tilt the application device.

Known application nozzles of such application systems or application devices for such compositions such as adhesives or sealants have the disadvantage, however, that the tip of the application nozzle is covered by the application device during the application process. This has the result that the user deliberately or accidentally tilts the application nozzle to have a better view of the application nozzle. This also has the result that the user adopts a comparatively unnatural posture, which produces greater fatigue of the user.

U.S. Pat. No. 5,249,876 describes a nozzle for the distribution of a filling material in corner regions. The nozzle comprises a slanted opening within a tip which is oriented at a 45° angle to an outer surface. The operability, in particular in corner regions, should be improved by the slant. The above-named problems on the use of the nozzle are, however, not satisfactorily remedied.

SUMMARY

It is therefore the object of the present invention to further develop in an advantageous manner an application nozzle, an application device and a method of applying a gel-like and/or pasty composition, in particular such that the application or spreading on of gel-like and/or pasty compositions such as adhesives or sealants to a substrate is simplified, the visibility of the application nozzle is improved during the application of the composition and the handling ability and the ergonomics of the system is improved during the application of the system by f the application system or by the application nozzle.

This object is satisfied in accordance with the invention by an application nozzle having the features recited herein. Provision is accordingly made that an application nozzle is provided for an application system for gel-like and/or pasty compositions, wherein the application nozzle has an inlet region and an outlet region for the composition, wherein the application nozzle has a plane, in particular a plane of symmetry, extending in the longitudinal direction of the application nozzle and the outlet region of the application nozzle comprises a contact region for the application nozzle on a substrate, which contact region stands perpendicular to the plane of symmetry, and an outlet opening for the composition and the contact region is at least partly slanted.

Gel-like and/or pasty compositions can in particular be adhesives or sealants of all kinds. It is in particular conceivable in connection with adhesives that they are ready-made adhesives or accelerated single-component adhesives to which an accelerator or booster is added for a faster hardening or they are two-component adhesives. Silicone sealants or the like or silicone-based sealants which are used e.g. in the area of sealing joints can be named as sealants, for example.

A gel-like composition in this respect in particular has a gel-like consistency, i.e. a consistency like a gel. A gel is a rule defined as a finely dispersed system of at least one solid and one liquid phase. The solid phase in this respect forms a sponge-like three-dimensional network whose pores are filled with a liquid (lyogel) or with a gas (xerogel); if the network is highly porous and if air is the deposited gas, the gel is also called an aerogel. Both phases interfuse completely in this process (bicoherent).

A pasty composition in this respect in particular has a pasty consistency, i.e. a consistency like a paste (that is a solid-liquid mixture (suspension) with a high solid content) and in particular has sheer thinning properties, usually preferably thixotropic.

The contact region is in particular the region of the application nozzle which is to be placed adjacent to the substrate on which the gel-like and/or pasty composition is to be applied and which is also placed adjacent during the application.

The outlet opening is preferably disposed at a surface which is adjacent to the plane formed by the contact region.

In a specific embodiment, the outlet opening is adjacent to the contact region.

The outlet region can comprise (at least) two sections, namely the contact region and the outlet opening. In this respect, the contact region and the outlet opening can form a common opening, wherein a margin of the contact region lies in a first plane and a margin of the outlet opening lies in a second plane, with the first and second planes having an angle with respect to one another (of >0°) (preferably >45° or >60° or ≤135° or ≤110°). The outlet opening (or a margin surrounding the outlet opening) can therefore be kinked with respect to the contact region (or with respect to a margin surrounding the contact region). Unlike in the prior art (U.S. Pat. No. 5,249,876), not only an opening is therefore formed which simultaneously represents the contact region and the outlet opening, but rather two separate (slanted) sections are provided which are kinked with respect to one another so that the contact region and the outlet opening are delineated from one another structurally (for example by an imaginary kink line which can be defined by a line of intersection of the above-named first and second planes).

The contact region can be polygonal, in particular quadrilateral. The outlet opening can equally be polygonal, in particular triangular. The contact region and the outlet opening can together form a (kinked) pentagon, i.e. in particular a combination of a quadrilateral contact region and a triangular outlet opening. In this connection, a side of the quadrilateral contact region can form a common side (connection line) with a side of the triangular outlet opening. Alternatives are conceivable (for example a quadrilateral contact region and a quadrilateral outlet opening which together form a (kinked) quadrilateral or a triangular contact region which together form a (kinked) pentagon). The contact region and the outlet region can therefore implement a common quadrilateral (in particular a pentagon) in a projection onto the plane of the contact region.

The slanting of the contact region in particular has the effect that the application device is tilted with the application system inserted into the application device when the contact region of the application nozzle is placed adjacent to the substrate such that the application nozzle is visible during the application.

The advantage therefore in particular results that the application of a composition is simplified, the visibility of the application nozzle during the application of the composition is improved and in particular the handling ability and ergonomics for the user is improved during the application of the composition by the application system or of the application device.

The advantage results from the part slant that the user of the application system substantially places the contact region of the application nozzle correctly onto the substrate by himself or "automatically" during the application of the composition such as an adhesive or a sealant and hereby makes possible an application of the composition such as an adhesive or a sealant which is as even as possible.

The contact region of the application nozzle is, for example, the tip of the application nozzle and in particular the region with which the application nozzle is placed adjacent to a substrate and through which the application also passes during the application.

The further advantage furthermore results from the part slanting of the contact region of the application nozzle that the contact region of the application nozzle remains visible during the application and the user therefore does not tend to tilt the application nozzle or the application system. Such an avoidance of the tilting contributes to the contact region of the application nozzle remaining correctly aligned with respect to the substrate and therefore to a very even application being possible.

The advantage furthermore results from the part slanting of the contact region that the user can adopt a more natural posture since he substantially aligns the contact region correctly with respect to the substrate by himself or "automatically". The visibility of the contact region of the application nozzle during the application also serves the purpose that the user does not have to move his head, e.g. for monitoring looks, but can rather adopt a comparatively relaxed posture overall. It is also now not required to the same extent in comparison with e.g. non-slanted nozzles to bend the back a lot during the application in order e.g. to ensure a correct alignment of the application nozzle. The user therefore does not tire as fast, which likewise facilitates a more even application. The handling ability and ergonomics during the application of the composition by the application system or by the application device can thus be improved overall.

It is furthermore possible that the application nozzle has a longitudinal axis and that the contact region is slanted with respect to the longitudinal axis. The longitudinal axis can be disposed in the plane extending in the longitudinal direction of the application nozzle, in particular in the plane of symmetry extending in the longitudinal direction of the application nozzle.

It is in particular conceivable that the contact region is slanted in the longitudinal cross-section of the application nozzle with respect to the longitudinal axis, in particular such that the plane defined by the slant stands perpendicular on the plane of the longitudinal cross-section which can also be or also is simultaneously the plane of symmetry extending in the longitudinal direction of the application nozzle.

The contact region of the application nozzle preferably has a polygonal cross-section, in particular a triangular, quadrilateral or pentagonal cross-section. The stability of the application nozzle or of the total application device, when it is placed adjacent to the substrate, is thus increased in comparison with a round cross-section of the contact region.

The corners are typically preferably rounded in the cross-section of the contact region, in particular at the inner side of the application nozzle.

The roundings in the corner regions or in the marginal region result in a reduction of the material loss when the application nozzle has to be replaced. For the roundings reduce the volume of the space in the interior of the application nozzle which is flowed through by the composition.

The outlet opening for the composition is preferably located at a surface of the application nozzle which is adjacent to the plane formed by the contact region. In the use of the application nozzle, for example, at a manually operated application nozzle for applying adhesive strips, the outlet opening is preferably located far back at the application nozzle in the direction of movement of the application device.

It is furthermore conceivable that the outlet opening for the composition is polygonal, in particular triangular. The geometry of the outlet opening also decisively determines the shape of the composition applied through the application nozzle, the so-called strip.

It is, however, generally conceivable to use any other suitable geometry.

It is possible that the outlet opening for the composition is at least partly rounded in at least one corner region and/or marginal region.

Provision can furthermore be made that the slanting of the contact region is formed by an angular range between (approximately) 50° to (approximately) 85°, in particular 60° to (approximately) 75°, preferably 65° to 70° (with respect to the longitudinal axis of the application nozzle).

The slant of the contact region can, for example, amount to (approximately) 68° with respect to the longitudinal axis of the application nozzle.

The outlet opening can be aligned (substantially) in parallel with the longitudinal axis of the application nozzle, and can preferably have an angle of at least 1°, further preferably at least 10°, and/or preferably at most 25°, further preferably at most 30°, with respect to the longitudinal axis of the application nozzle. An angle between a plane defined by the contact region and a plane defined by the outlet opening can represent a sum of the above values with respect to the contact region and the outlet opening (it must be emphasized in this respect that any combination of lower and upper limit values can be possible).

A margin of the contact region preferably forms a U. A margin of the outlet opening preferably forms a V.

It is furthermore possible that the application nozzle has at least one edge and/or rib, wherein the edge and/or rib is/are in particular constituted and formed such that the application nozzle has an increased bending stiffness and/or torsional stiffness in comparison with an application nozzle having a substantially round cross-section. The advantage thereby in particular results that the stability of the nozzle can be increased overall. This is in turn advantageous with respect to the application of the composition such as an adhesive, which is applied onto a substrate through the nozzle, which is to be distributed or applied through the nozzle.

The ribs can be configured as reinforcement ribs and can then be used when a particular and additional reinforcement and stiffening is considered required and desirable.

It is furthermore conceivable that the application nozzle has a (substantially) polygonal cross-section with respect to the cross-section.

The advantage in particular results from the use of a (substantially) polygonal cross-section that the application nozzle has an increased bending stiffness and/or torsional stiffness in comparison with an application nozzle having a substantially round cross-section. The advantage thereby in particular also results that the stability of the nozzle can be increased overall. This is in turn advantageous with respect to the application of the composition such as an adhesive, which is applied onto a substrate through the nozzle, which is to be distributed or applied through the nozzle. A kinking of the nozzle during the placement of the nozzle adjacent to the substrate is also hereby advantageously avoided or can be hereby prevented. A (substantially) polygonal cross-section preferably has 3 to 7 sides, particularly preferably 3 to 6 sides, for example 4 sides.

Provision can additionally be made that the application nozzle has a cross-section or a shape which has at least one concave section, wherein the application nozzle in particular has at least one flattened side surface, with the application nozzle preferably having two flattened side surfaces.

The flattened side surfaces are in particular constituted and formed such that they are offset inwardly in the direction of the longitudinal axis of the application nozzle with respect to the cross-section of the application nozzle or result in a partly concave shape of the cross-section of the application nozzle. Such a shape has the advantage that the volume in the interior of the application nozzle, which is flowed through or run through by the composition, in particular by the adhesive, in comparison with a nozzle having a substantially round cross-section. The advantage hereby results that at the end of the application of the composition onto a substrate the volume of the composition remaining in the nozzle is smaller in comparison with a nozzle having a substantially round cross-section. This allows an improved utilization of the composition because the inner space of the application nozzle flowed through by the composition represent a dead volume which can substantially not be used or can only be used with difficulty. There is consequently less material loss in the application nozzle compared with nozzles which have different cross-sections.

The present invention furthermore relates to an application system having the features described herein. Provision is accordingly made that the application system is provided with at least one application nozzle in accordance with any one of the devices described herein.

An application system can, for example, be configured such that it is an application system for two-component materials or single-component adhesives having an additional accelerator or booster.

Provision can e.g. be made with two-component materials that a wet-reactive composition received in a first packaging unit comprises a hardener component received in a second packaging unit and a dynamic mixer configured for insertion into an application device and for driving thereby, wherein the first packaging unit is a tubular bag and the second packaging unit is a cartridge having a rigid wall.

The application nozzle can be substantially hollow when it is a question of single-component adhesives.

It is also conceivable that a static mixer is connected to the application nozzle or is integrated into it. Such a static mixer can comprise static mixing elements such as rotor-like or vane-like deflection elements which effect a mixing of the components of the composition.

It is furthermore conceivable that a dynamic mixer is connected to the application nozzle or is integrated into it. The dynamic mixer can have at least one broaching element for opening the first and/or second packaging units, two pre-mixing chambers and a rotor having rotor blades and configured to effect an advance in connection with the mixing process. Such dynamic mixers are described, for example, in WO 2012/116883 A1 and in WO 2012/116863 A1.

It is conceivable that the first and second packaging units are fixedly connected to one another. A plurality of mixers can be received in a packaging separate from the combination of the first and second packaging units. The application system can be a component of an application device, for example of an application gun, which is battery-operated, operated by a rechargeable battery and/or operated by compressed air and/or is provided with a power connection.

The present invention furthermore relates to an application device having the features described herein. Provision is accordingly made that an application device, in particular an application device operated by a rechargeable battery, is provided with at least one application nozzle in accordance with any one of the devise described herein and/or with at least one application system described herein.

In addition, the present invention relates to a method of applying gel-like and/or pasty compositions. Provision is accordingly made that in a method of applying gel-like and/or pasty compositions, an application nozzle is used in accordance with any one of the devices and/or an application systems and/or by application devices described herein.

BRIEF DESCRIPTION OF THE DRAWINGS

The invention will be explained in more detail hereinafter with reference to the drawings.

DETAILED DESCRIPTION OF THE EMBODIMENTS

Figure 1:
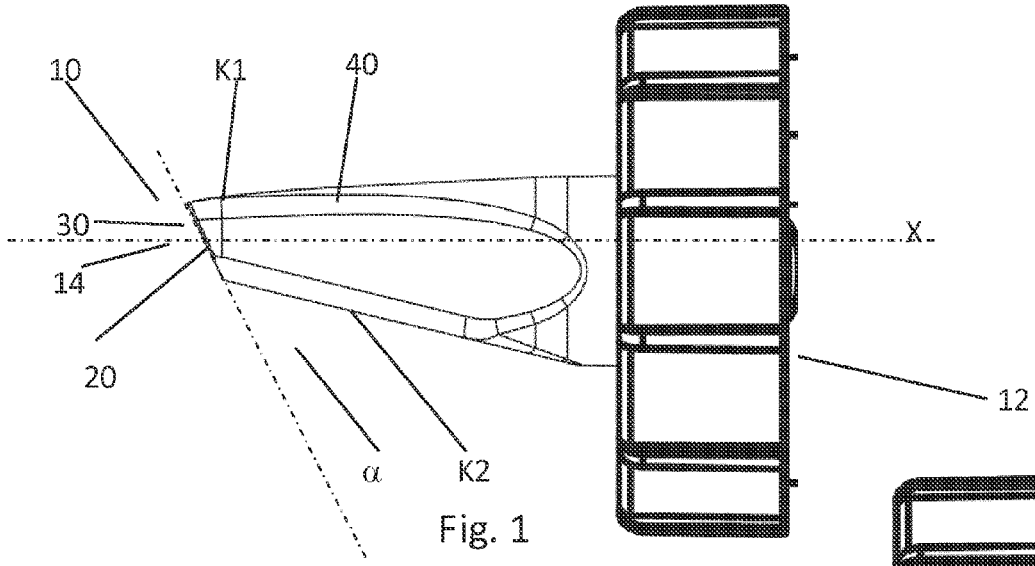
FIG. 1 is a side view of an embodiment of an application nozzle in accordance with the invention.
Figure 2:
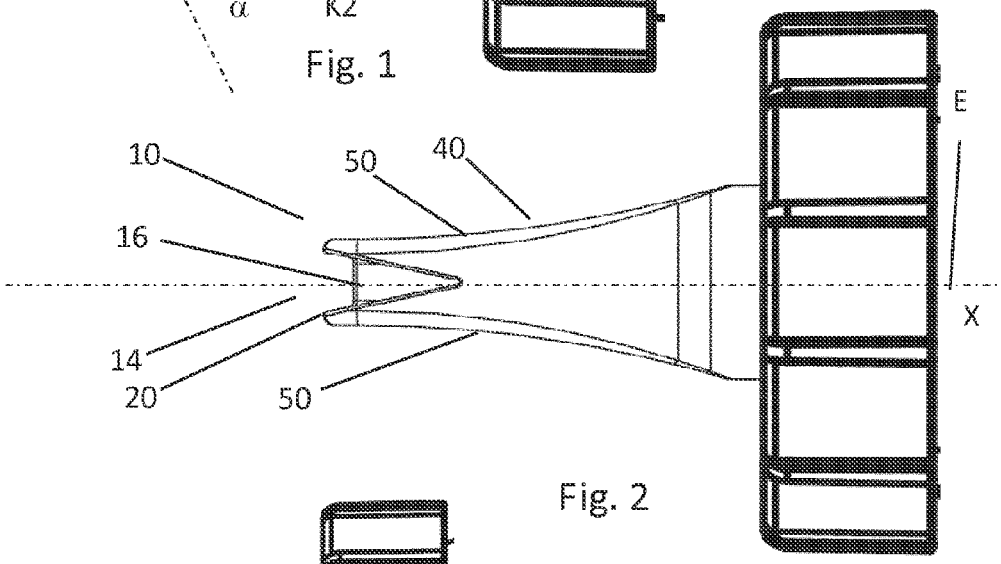
FIG. 2 is a view of the embodiment of the application nozzle shown in FIG. 1 from above.
Figure 3:
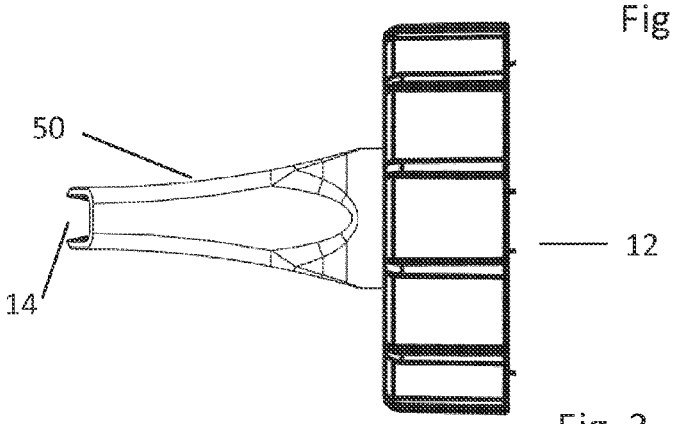
FIG. 3 is a view of the embodiment of the application nozzle shown in FIG. 1 from below.

FIG. 1 shows a side view of an embodiment of an application nozzle 10 in accordance with the invention and FIG. 2 shows a view of the embodiment of the application nozzle shown in FIG. 1 from above. FIG. 3 shows a view of the embodiment in accordance with FIG. 1 in a view from below.

Figure 4:
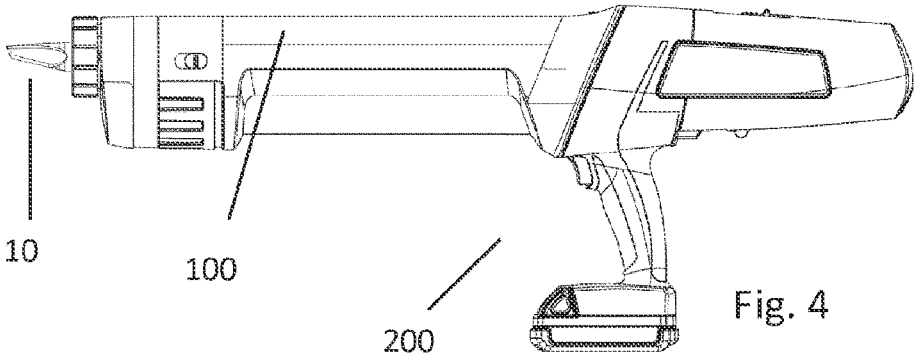
FIG. 4 is a side view of an embodiment of an application device having the application nozzle shown in FIGS. 1 and 2.
Figure 5:
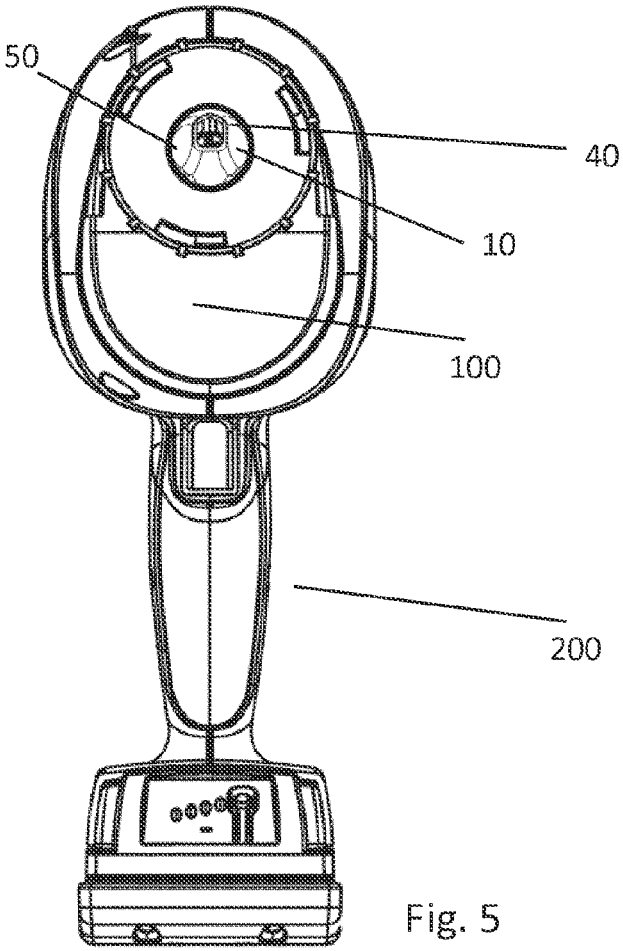
FIG. 5 is a frontal view of the embodiment of an application device in accordance with FIG. 4.

The application nozzle 10 is an application nozzle 10 for an application system 100, shown e.g. in FIG. 4 or 5, of an application device 200 for applying a gel-like and/or pasty composition, wherein the composition is an adhesive, for example. It is generally conceivable that a sealant can also be applied using such a nozzle.

The application nozzle 10 has an inlet region 12 and an outlet region 14 for the composition, wherein the application nozzle 10 has a plane of symmetry E extending in the longitudinal direction of the application nozzle 10 in which the longitudinal axis X of the application nozzle 10 is also disposed.

The outlet region 14 of the application nozzle 10 comprises a contact region 20 for the application nozzle 10 on a substrate standing (substantially) perpendicular to the plane of symmetry E.

The composition, here in particular the adhesive, is pressed through an inlet region 12 of the application nozzle 10 by the application system 100 inserted into the application device 200 and exits the nozzle in the outlet region 14.

When the contact region 20 of the application nozzle 10 is placed adjacent to the substrate, the composition such as the adhesive can (only) exit the nozzle through the outlet opening 16. This has the result that a so-called (adhesive) strip arises whose geometry is defined by the geometry of the outlet opening 16. In the embodiment shown, the outlet opening 16 has a (substantially) triangular shape.

It has been found that the present invention brings about large advantages above all on the application of triangular strips.

The shown application nozzle 10 is consequently a triangular nozzle by which a triangular strip can be applied. This e.g. has the advantage that the height of the strip can be higher in comparison with a round strip with the same amount of adhesive and this allows higher clearances.

A tilting of the application nozzle can have the result that the composition not only exits through the outlet opening 16, but also beside the outlet opening 16 in the region of the edges of the contact region 20. This e.g. results in the unwanted effect that the strip produced has a widened base. The outlet opening 16 is furthermore also de facto increased in size overall by such a tilting so that the strip also becomes higher and its geometry changes.

The above-described change of the strip geometry also takes place to a similar extent and in a similar manner with other strip geometries.

It is in particular required in connection with the adhesive bonding of disks such as the adhesive bonding of replacement disks in motor vehicles to achieve a strip geometry which is as even as possible. It is consequently desirable to avoid an unwanted tilting of the application nozzle 10 such as is achieved by the embodiment in accordance with the invention.

The contact region 20 for placing adjacent to a substrate for applying the adhesive is at least partly slanted by the slanting 30.

The contact region 20 (or a plane defined by a slant) is slanted in the longitudinal cross-section of the application nozzle 10 with respect to the longitudinal axis X, in particular such that the plane defined by the slant stands perpendicular on the plane E of the longitudinal cross-section.

The slant 30 of the contact region 20 has an angle $\alpha$ which is selected in an angular range between approximately 50° to approximately 85°, in particular 60° to approximately 75°, preferably 65° to 70°. In the example shown, the angle $\alpha$ is approximately 68° since this angle has proved particularly advantageous to achieve the effects in accordance with the invention in an exceptional manner.

As can further be seen from FIG. 1, an upper crown line K1 and the longitudinal axis X include an angle which is smaller than the angle which is included by a lower crown line K2 and the longitudinal axis X. This also contributes to the stiffness of the application nozzle 10 being increased, but at the same time the dead volume also being reduced (as part of a replacement of the application nozzle 10).

This arrangement furthermore additionally improves the user's visibility of the outlet opening.

The application nozzle 10 has (at least) one (optionally flattened) edge 40 at both sides, with the edge 40 in particular being constituted and formed such that the application nozzle has an increased bending stiffness and/or torsional stiffness in comparison with an application nozzle having a substantially round cross-section.

It also thereby results that the application nozzle 10 has a substantially polygonal cross-section or a polygonal cross-section with respect to its cross-section.

The application nozzle 10 furthermore has a cross-section which has at least one concave section in the region of the flattened side surface 50.

The flattened side surfaces 50 are in this respect constituted and formed such that they are offset inwardly in the direction of the longitudinal axis X of the application nozzle 10 with respect to the plan view (see in particular FIG. 2) of the application nozzle 10 or result in a partly concave shape of the cross-section of the application nozzle 10. It is thereby achieved that the volume in the interior of the application nozzle 10, which is flowed through or run through by the composition, is reduced in comparison with a nozzle having a substantially round cross-section.

At the end of the application of the composition to a substrate, the volume of the composition remaining in the application nozzle 10 is smaller in comparison with a nozzle having a substantially round cross-section. This allows an improved utilization of the composition because the inner space of the application nozzle 10 flowed through by the composition represents a dead volume which can substantially not be used or can only be used with difficulty. There is consequently less material loss in the application nozzle 10 compared with nozzles which have different cross-sections.

FIGS. 4 and 5 show an embodiment of an application device 200 operated by a rechargeable battery having the application nozzle 10 shown in FIG. 1.

The application device 200 has an application system 100 which can be inserted into the application device 200 or which is a component of the application device 200.

The invention claimed is:

1. An application nozzle for an application system for gel-like or pasty compositions, the application nozzle comprising:

an inlet region and an outlet region for the composition, a plane extending in a longitudinal direction of the application nozzle, the outlet region comprising a contact region for the application nozzle on a substrate standing perpendicular to the plane and an outlet opening for the composition, margins of the contact region lying in a first plane and margins of the outlet opening lying in a second plane, the first and second planes being angled relative to one another, the outlet opening being opened adjacent the contact region and having a width substantially the same as a width of the contact region; and an upper crown line and a lower crown line opposite the upper crown line, in a side view perpendicular to the plane, the upper crown line of the application nozzle being inclined in relation to the longitudinal direction at a first angle, and the lower crown line of the application nozzle opposite the upper crown line being inclined in relation to the longitudinal direction at a second angle, the first angle being smaller than the second angle, and the contact region and the outlet opening being delineated from one another structurally as two separate sections that are kinked with respect to one another, and the contact region being at least partly slanted.

2. The application nozzle in accordance with claim 1, wherein the outlet opening is disposed at a surface which is adjacent to a plane formed by the contact region.

3. The application nozzle in accordance with claim 1 wherein the outlet opening is adjacent to the contact region.

4. The application nozzle in accordance with claim 1, wherein the contact region of the application nozzle has a polygonal shape when viewed along a longitudinal direction.

5. The application nozzle in accordance with claim 1, wherein the outlet opening for the composition is polygonal.

6. The application nozzle in accordance with claim 1, wherein a slant of the at least partly slanted contact region is formed by an angular range between approximately 50° to approximately 85°.

7. The application nozzle in accordance with claim 6, wherein the outlet opening for the composition is triangular.

8. The application nozzle in accordance with claim 1, wherein the application nozzle has at least one edge or rib.

9. The application nozzle in accordance with claim 8, wherein the edge or rib is constituted and formed such that the application nozzle has an increased bending stiffness or torsional stiffness in comparison with an application nozzle having a substantially round cross-section.

10. The application nozzle in accordance with claim 1, wherein the application nozzle has one of a substantially polygonal cross-section and a polygonal cross-section.

11. The application nozzle in accordance with claim 1, wherein the application nozzle has a cross-section or a shape which has at least one concave section.

12. The application nozzle in accordance with claim 11, wherein the application nozzle has at least one flattened side surface.

13. The application nozzle in accordance with claim 12, wherein the application nozzle has two flattened side surfaces.

14. An application device, comprising at least one application nozzle in accordance claim 1.

15. The application device in accordance with claim 14, wherein the application device is operated by a rechargeable battery.

16. The application nozzle in accordance with claim 1, wherein the plane is a plane of symmetry.

17. The application nozzle in accordance with claim 1, wherein the contact region is at least partly slanted with respect to the longitudinal direction.

18. The application nozzle in accordance with claim 1, wherein the outlet region comprises only one outlet opening.

19. An application system comprising:

an application nozzle for an application system for gel-like or pasty compositions, the application nozzle having an inlet region and an outlet region for the composition and having a plane extending in a longitudinal direction of the application nozzle, the outlet region comprising a contact region for the application nozzle on a substrate standing perpendicular to the plane, margins of the contact region lying in a first plane and margins of the outlet opening lying in a second plane, the first and second planes being angled relative to one another, and an outlet opening for the composition, the outlet opening being opened adjacent the contact region and having a width substantially the same as a width of the contact region, and the nozzle including an upper crown line and a lower crown line opposite the upper crown line, in a side view perpendicular to the plane, the upper crown line of the application nozzle being inclined in relation to the longitudinal direction at a first angle, and the lower crown line of the application nozzle opposite the upper crown line being inclined in relation to the longitudinal direction at a second angle, the first angle being smaller than the second angle, and the contact region and the outlet opening being delineated from on another structurally as two separate sections that are kinked with respect to one another, and the contact region being at least partly slanted.

20. A method of applying gel-like and/or pasty compositions, the method comprising:

operating an application nozzle, the application nozzle including an inlet region and an outlet region for the composition, and a plane extending in a longitudinal direction of the application nozzle, the outlet region comprising a contact region for the application nozzle on a substrate standing perpendicular to the plane and an outlet opening for the composition, margins of the contact region lying in a first plane and margins of the outlet opening lying in a second plane, the first and second planes being angled relative to one another, the outlet opening being opened adjacent the contact region and having a width substantially the same as a width of the contact region, and the nozzle including an upper crown line and a lower crown line opposite the upper crown line, in a side view perpendicular to the plane, the upper crown line of the application nozzle being inclined in relation to the longitudinal direction at a first angle, and the lower crown line of the application nozzle opposite the upper crown line being inclined in relation to the longitudinal direction at a second angle, the first angle being smaller than the second angle, and the contact region and the outlet opening being delineated from one another structurally as two separate sections that are kinked with respect to one another, and the contact region being at least partly slanted.

* * * * *